United States Patent [19]

Nishikawa

[11] 4,260,237

[45] Apr. 7, 1981

[54] ELECTROPHOTOGRAPHIC APPARATUS

[75] Inventor: Masaji Nishikawa, Hachioji, Japan

[73] Assignee: Olympus Optical Co., Ltd., Tokyo, Japan

[21] Appl. No.: 9,582

[22] Filed: Feb. 5, 1979

[30] Foreign Application Priority Data

Feb. 10, 1978 [JP] Japan ..... 53/14473

[51] Int. Cl.[3] ..... G03G 15/00

[52] U.S. Cl. ..... 355/3 FU; 219/216

[58] Field of Search ..... 355/3 FU, 3 R, 71; 219/216, 388; 430/124

[56] References Cited

U.S. PATENT DOCUMENTS

| | | | |
|---|---|---|---|
| 3,655,280 | 4/1972 | Zoppoph | 355/3 FU |
| 4,132,477 | 1/1979 | Watabe et al. | 355/71 X |

FOREIGN PATENT DOCUMENTS

| | | | |
|---|---|---|---|
| 1424045 | 2/1976 | United Kingdom | 355/3 FU |

*Primary Examiner*—R. L. Moses

*Attorney, Agent, or Firm*—Haseltine and Lake

[57] ABSTRACT

An electrophotographic apparatus for obtaining duplicated copies based on an image-like information comprising a light source, a photosensitive charge retentive member, a development device, an emissive fixing device and a cleaning device. The emissive fixing device comprises a radiation member for generating light having a wavelength which is at least mainly in a region other than the wavelength region of light to which the charge retentive member is sensitive and heats toner particles.

10 Claims, 3 Drawing Figures

ELECTROPHOTOGRAPHIC APPARATUS

BACKGROUND OF THE INVENTION

The present invention relates to an electrophotographic apparatus.

An electrophotographic process for obtaining a plurality of duplicated copies by repeating the development step and the transfer step based on an electrostatic latent image formed on a photosensitive conductor such as selenium, has been well known from U.S. Pat. No. 2,951,443.

Another electrophotographic process for obtaining a plurality of duplicated copies by utilizing persistent conductivity due to fatigue caused by light image projected on the photosensitive conductor, has also been disclosed in for example Japanese Patent Application Publication Nos. 20,347/65 and 42,469/71. As a process similar to a process for utilizing persistent conductivity of such photosensitive conductor, an electrophotographic process for obtaining a plurality of duplicated copies by utilizing a conductive latent image formed by metallic silver formed on the exposed portion of silver salt photographic emulsion has been well known. Moreover, an electrophotographic process for obtaining a plurality of duplicated copies by repeating uniform charging, uniform exposure and transfer steps based on toner image permanently or temporarily formed on a photosensitive conductor has been well known from, for example, Japanese Patent Application Publication No. 21,095/65 and Japanese Patent Laid-open No. 8,730/72. A further electrophotographic process for obtaining a plurality of duplicated copies by repeating the formation of an electrostatic latent image formed on a charge retentive member having a dielectric layer by modulating a corona ion flow based on the electrostatic latent image formed on a photoconductive screen having, for example, a plurality of fine apertures, has been well known.

While as means for fixing toner image formed on a recording paper in the prior electrophotographic technique the feature of fixing toner image by the light emitted from an incandescent lamp such as halogen lamp or xenon electronic-flash lamp, has been disclosed in, for example, U.S. Pat. No. 2,807,703, it is very preferable to utilize the incandescent lamp or the flash lamp for fixing the toner image since the time upto starting of fixation is very short and particularly in the case of using the flash lamp the toner image can be fixed almost without heating the record paper so that the fixing device can not be heated and thus a fear or causing a fire does not occur. However, when the electrophotographic apparatus is constituted by applying such a fixing device having emitting means to the above electrophotographic apparatus for obtaining a plurality of duplicated copies by only one exposure, the electrostatic latent image formed on the photosensitive conductor or the photoconductive screen disappears by the light leaked from the fixing device during the multiple copying step or in the electrophotographic apparatus for obtaining a plurality of duplicated copies based on a master toner image formed on the photosensitive conductor uneven density occurred by a partial projection due to the leakage light from the fixing device or in an electrophotographic apparatus utilizing the persistent conductivity of the photosensitive conductor a disappearance of image occurred by increase of whole or a partial conductive latent image due to the leakage light.

In order to eliminate these disadvantages it is provided that the fixing device is constructed so that the light should not be leaked. It is, however, found that realization of such a construction is very difficult since the recording paper with toner image thereon must be passed through the fixing device. Even if the conveying path for recording paper is bent to prevent the light from leaking, its construction becomes complicated and expensive. Particularly, when the light for fixing with a value in extent capable of selectively fixing only the toner image is generated by a large light source of simultaneous emitting type such as a xenon electronic-flash lamp, it is very difficult to keep the leakage light inside to an extent that the leakage light does not affect the photosensitive charge retentive member.

SUMMARY OF THE INVENTION

It is an object of the present invention to eliminate the above described disadvantages.

It is another object of the present invention to provide an electrophotographic apparatus having a fixing device which is so constructed that in the case of obtaining a duplicated copy based on image-like information formed on a photosensitive charge retentive member, when a toner image formed on a recording paper is fixed by an emitting type fixing heat source, such as an incandescent lamp or a xenon electronic-flash lamp, the photosensitive charge retentive member may not be exposed by leakage light from the heating source.

An electrophotographic apparatus for obtaining a plurality of duplicated copies from image-like information formed on a charge retentive member by one exposure, the apparatus comprising: a light source for illuminating a document to be copied, a photosensitive charge retentive member for forming image-like information thereon based on an optical image of the document through an optical system, a development means for forming a toner image on the charge retentive member to be transferred to recording paper based on the image-like information, a radiative fixing means for heating and fixing the toner image formed on the recording paper and including a radiation means for generating light having a wavelength at least mainly in a region other than the wavelength region of light to which the charge retentive member is sensitive and heats toner particles, and a cleaning means for eliminating residual toner particles after necessary member of transfer times are completed.

The development device directly develops the image-like information formed on the charge retentive member. The apparatus further comprises a transfer member for forming secondary image-like information thereon by transferring the image-like information formed on the charge retentive member. The image-like information formed on the charge retentive member is a toner image. The image-like information formed on the charge retentive member is an electrostatic latent image. The image-like information formed on the charge retentive member is a conductive image. The radiative fixing device comprises a radiation source and filter means for eliminating a radiation in a wavelength region of light to which the charge retentive member is sensitive. The radiation source is a xenon electronic-flash lamp or a halogen lamp. The housing is provided for enclosing the xenon electronic-flash lamp, the inner surface of the housing is coated to form a reflecting mirror and the filter means is provided at the opening of the housing. The filter means is made in a cylindrical shape and the xenon electronic-flash lamp is mounted in the cylindrical filter.

DESCRIPTION OF THE PREFERRED EMBODIMENT

Figure 1:
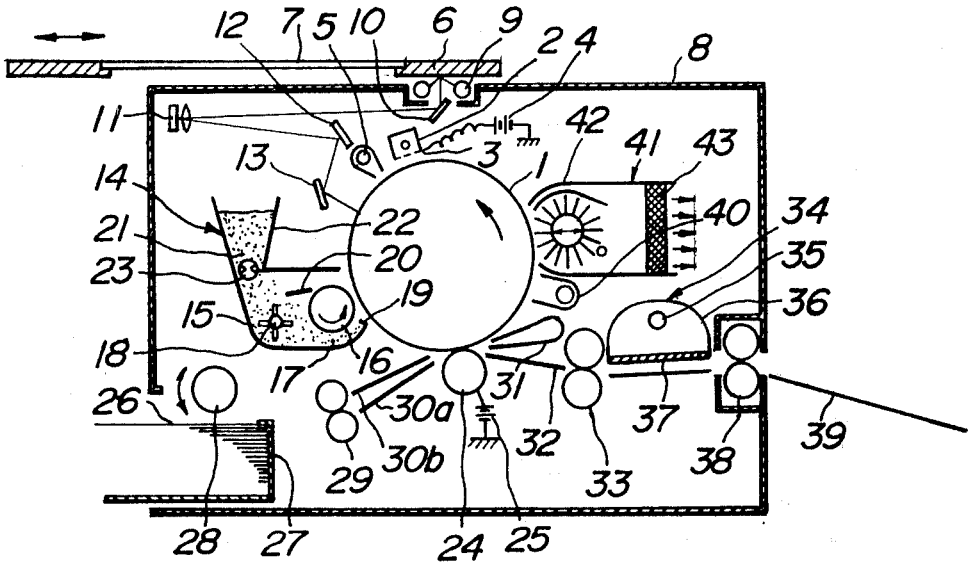
FIG. 1 is a diagrammatic elevational view, in section, showing a construction of an electrophotographic apparatus according to the present invention.

Referring now to the drawing, one embodiment of an electrophotographic apparatus according to the present invention will be described.

FIG. 1 show an electrophotographic apparatus for obtaining a plurality of duplicated copies by repeating development and transfer steps based on an electrostatic latent image formed on a photosensitive charge retentive member. As a photosensitive charge retentive member use is made of a drum shape photosensitive conductor 1 having small dark decay. The drum 1 comprises a Parylene film (trade mark, made by Union Carbide Company), formed on an Al drum as a barrier layer, an amorphous Se having a thickness of 15–60$\mu$ formed on the film and an Se-Te alloy having a thickness of few microns formed on the amorphous Se by vacuum deposition. It is preferable to make the thickness of the photoconductive layer consisting of an amorphous Se and an alloy of Se-Te thin, practically 20–25$\mu$ since the thin photoconductor has large electrostatic capacitance so that the latent image does not change by give and take of the charge. The photosensitive drum 1 is supported for rotation in the direction of the arrow and is uniformly charged by a corona charger 2. In this embodiment the corona charging is realized by arranging a control grid 3 consisting of metallic grid having a pitch of 0.5–2 mm at a position separated by a few millimeters from the photoconductive drum 1 at its opening, connecting a D.C. power supply source 4 of about 450–500 V to the control grid 3, and uniformly charging the photoconductive drum 1 upto the voltage of the control grid 3 with positive polarity. The uniformly charged photoconductive drum 1 is illuminated by a trimming lamp 5 to discharge the charges of the portions other than the frame of the effective recording portion. The trimming lamp 5 comprises a light source capable of controlling ON-OFF switching with high speed by selection of a lighting circuit such as fluorescent lamp or a conventional lamp, a housing of these light sources and a mechanical shutter for making opening and closing operations with high speed which is provided at the opening portion of the housing. A copy board 6 comprises a transparent glass plate 7 which is movably arranged in the both directions of the in synchronization with rotation of the photosensitive drum 1 to a housing 8 of the apparatus. The electrostatic latent image consisting of positive charge corresponding to a light image is formed on the photoconductive drum 1 by projecting the light image of a document (not shown) placed on the glass plate 7 onto the uniformly charged photoconductive drum 1. In this embodiment the projection of the light image is realized by leading the illumination light from a light source of lamp 9 to the document placed on the transparent glass plate 7 and passing its reflected light through a reflection mirror 10, a projection lens 11 and reflection mirrors 12 and 13. If necessary, a shutter is provided in the light path of the light image projection to prevent circumferantial light from reaching the photoconductive drum 1 during multiple copying. However, if a proper member is arranged for lessening a space for passing the light between the copy board 6 and an optical system instead of providing such a shutter, the same function as the shutter can be obtained. The electrostatic latent image formed by the light image projection is received by toner particles charged with negative polarity at a developing device 14 and visualized as a toner image. In this embodiment a magnetic brush developing system utilizing a two component developer is adopted for the developing device 14. This developing device 14 comprises a container 15, a magnetic roller 16 for adhering toner particles to the photoconductive drum 1 in the container 15, an agitating vane 18 for mixing toner particles and carriers in a developer 17, a Doctor's blade 19 for limiting the length of toner particles of the developer 17 adhered to the magnetic roller 16, and a scraper 20 for scraping the developer 17 adhered to the magnetic roller 16. The developing container 15 is provided with a toner supplying container 22 having toner 21 accommodated therein, to make toner concentration in the developer 17 of desired value, for example, to make the mixing ratio of the toner more than 5% by weight by supplying the toner 21 in the developing container 15 with rotation of a knurling roller 23. It is preferable to make the resistance value of the developer 17 high in order not to worsen the electrostatic latent image formed on the photoconductive drum 1. To this end, use is made of iron powders which are subjected to a surface treatment by high resistance material or provision is made of a sleeve which is provided to the outer periphery of the magnetic roller 16, the surface of the sleeve is being subjected to a surface treatment by insulating material. The developing device 14 can also be provided with a developing electrode to control the density of the toner image by applying the bias voltage for development between the developing electrode and the photoconductive drum 1.

The toner image developed in the developing device 14 is transferred onto the recording paper between the photoconductive drum 1 and a biased transfer roller 24. In this embodiment a D.C. transfer bias voltage of about +600 V is applied to the biased transfer roller 24 from a biasing voltage source 25 since the toner image on the photoconductive drum 1 is formed by negative charged toner. The biased transfer roller 24 is formed as a rubber roller with a semiconductive property (volume resistivity $10^8$–$10^{10}$ $\Omega$·cm) having, for example, a Shore hardness of 30°–50° (JIS standard). The transfer bias voltage is depending on the voltage of the electrostatic latent image formed on the photoconductive drum 1, preferably made higher for the transfer efficiency. In the case of obtaining a plurality of duplicated copies based on the electrostatic latent image once formed on the photoconductive drum 1 the transfer bias charges are injected into the photoconductive drum 1 through the recording paper during transfer of toner image thereby to cause fogging in the background portion of the image. In order to transfer the latent image with high efficiency without causing fog in the background portion, the transfer bias voltage is preferably made about +600 V as described above for the voltage of the electrostatic latent image of about +400 V. In order to keep the potential latent image and the transfer bias voltage in a predetermined relation, it is very effective to control the charged amount by the control grid 3 during uniform charging due to the corona charger 2.

The recording papers 26, in this embodiment a sheet-like recording paper, are accommodated in a cassette 27 in stacked state, are fed to the transferred position one by one in synchronization with rotation of the photoconductive drum 1, and are conveyed between the drum 1 and the biased transfer roller 24 through a pair of feed rollers 29 and paper guides **30*a* and 30*b* and subjected to a transfer of the toner image formed on the drum 1 by a pressing force of the roller 24 and an action of the transfer field. Alternatively, as the recording paper use is made of a roll of recording paper which is cut into a predetermined length during the transfer step. The recording paper to which the toner image has been transferred is peeled off from the drum 1 by jet flow of a peeling off device 31 or a peeling blade (not shown). In this case the recording paper is at first peeled off from the drum 1 in a state being contacted to the biased transfer roller 24 and then separated from the roller 24. According to such a construction a discharging does not occur between the drum 1 and the recording paper at the time of peeling off of the paper so that the charges are held on the drum 1 and thus dotted stains do not occur in the background portion of the image in the next developing step. The recording paper which has been peeled off from the drum 1 is conveyed to an emissive fixing device 34 through a paper guide 32 and a pair of feed rollers 33 thereof to fuse or fix the toner image in the fixing device 34. The fixing device 34 is formed by mounting am optical filter 37 at the opening of a housing which encloses an emissive heat source 35 such as a xenon electronic-flash lamp or a halogen lamp in this embodiment. The optical filter 37 has a spectral transmission characterisitic which cuts off the light of photosensitive wavelength region of the photoconductive drum 1 and transmits the light of other wavelength region required to fix the toner image. The recording paper on which the toner image has been fixed or fused is taken out on a tray 39 as a final duplicated copy through a pair of rollers 38. A pair of rollers 33 positioned forward the emissive fixing device 34, viewed in the conveying direction of the recording paper are preferably constructed so as to contact each other with comparatively small pressure, or comprise a plurality of ring shaped rollers, since the recording paper on which unfixed toner image is held is conveyed between the rollers 33. If necessary, the rollers 33 can also be constructed to apply bias voltage of the same polarity as that of the toner charges to the roller (upper roller in FIG. 1) placed on the side being contacted to the toner image on the recording paper so as not to adhere the toner particles to the rollers 33**.

After completion of the transfer of the toner image, the photoconductive drum 1 is further rotated, the electrostatic latent image on the drum 1 is erased by an erasing lamp 40, the residual toner particles are cleaned by a cleaning device 41 and the preparation of the next electrostatic latent image formation is finished. The cleaning device 41 comprises, in this embodiment a cleaning brush 42 capable of moving in the radial direction of the drum 1 and a filter 43, the residual toner particles eliminated by touching the photoconductive drum 1 are absorbed through the filter 43. In the case of obtaining a plurality of duplicated copies from one and the same document, the above operations are repeated, or after the first transfer of the image the operations of developing and transferring are repeated in a desired time by utilizing the electrostatic latent image which remains and is held on the drum 1, without operating an optical system for projecting light image, the erasing lamp 40, the cleaning device 41, the corona charger 2, the trimming lamp 5 and the copying board 6.

In the electrophotographic apparatus shown in FIG. 1, when a plurality of duplicated copies are obtained by repeating developing and transferring steps from the electrostatic latent image formed on the photoconductive drum 1, even if the leakage light is caused from the fixing device 34, the drum 1 is not subjected to exposure effect, since leakage light is a light having the wavelength other than the photosensitive wavelength region of the drum 1. Therefore, a plurality of duplicated copies are effectively obtained without erasing the electrostatic latent image formed on the drum 1.

Figure 2:
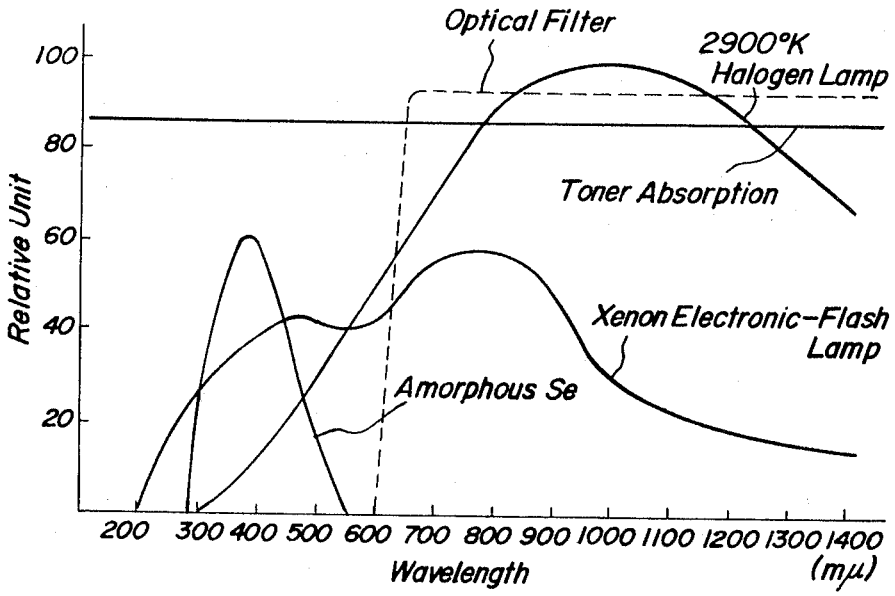
FIG. 2 is a graph showing the emission energy characteristics of an emissive heat source, the spectral transmission characteristics of an optical filter, the spectral sensitivity characteristics of amorphous selenium and the absorption characterisitcs of a toner particles, respectively.

FIG. 2 shows the spectral energy characteristic of an emissive heat source for fixing such as xenon electronic-flash lamp or halogen lamp, toner absorption characteristic, spectral sensitivity characteristic of amorphous Se and spectral transmission characteristic of the optical filter used in the present invention. In the first place, the spectral radiation energy characteristic of a xenon electronic-flash lamp is examined. It is understood that an energy total amount equal to or slightly more than that in a visible wavelength region lies in an infrared wavelength region. In a halogen lamp of 2,900° K. an energy amount in the infrared wavelength region is much more than that in the visible wavelength region. The absorption and heat generation of toner is almost uniform in both the visible wavelength region and the infrared wavelenegth region at a high rate. The spectral photosensitive characteristic of amorphous Se is within the range of 300 mμ–550 mμ. Therefore, in the electrophotographic apparatus shown in FIG. 1, if the photoconductive drum 1 is composed of amorphous Se, it is preferable to use the optical filter 37 for removing light having a wavelength of 300 mμ–550 mμ from light of the emissive heat source 35. As the optical filter 37 having such characteristics, use may be made of a sharp cut filter for cutting off light having a wavelength of less than 550 mμ–600 mμ as shown in FIG. 2. The optical filter 37 for cutting off light having such short wavelength hardly absorbs a wavelength of more than the cut off wavelength, for instance, colored glass or plastics, which can advantageously be used from the view point of price and handling. In addition, the may be made of a filter or a reflecting mirror with the aid of an interference film. Further, if light having a wavelength of less than 550 mμ–600 mμ is cut off from emitted light of the emissive heat source 35 by the optical filter 37, the toner fixing energy is reduced, but its ratio is about $\frac{1}{3}$ in the case of a xenon electronic-flash lamp and is negligible in the case of a halogen lamp, so that there is no trouble in practice. As a photoconductive layer of the photosensitive drum 1, if use is made of a spectral sensitized layer made by depositing Se-Te alloy or the like having a thickness of less than several μ on amorphous Se, a sensitized layer made by adding each kind of dyes of ZnO, or an organic photoconductive layer sensitized by adding 2,4,7-trinitro-9-fluorenon (TNF) to polyvinyl carbazole (PVK) at an almost equivalent mole ratio, the spectral sensitivity extends to the region having a wavelength of 600 mμ–700 mμ. To the thus sensitized photoconductive drum 1, in order to remove light of the photosensitive wavelength region from irradiated light of the emissive heat source 35, it is necessary to use the optical filter 37 having the cut off wavelength characteristic on the side of a long wavelength, thereby reducing energy utilized for toner fixation as compared with the above case, but the reduction to such degree, as understood from FIG. 2, is within the range which is sufficiently compensated by a total increase of the amount of emitted light and there is no trouble in practice.

In addition, the emissive fixing device 34 shown in FIG. 1 is made by surrounding the emissive heat source 35 with the housing 36 from three sides and mounting the optical filter 37 for preventing the light from leaking into the opening portion, but it is preferable that the inner surface of the housing 36 is polished, plated or coated for the purpose of providing high reflectivity. In the case of using a flash lamp as the emissive heat source 35, since light emission time is very short, it is preferable to fix in the form of a band by intermittently lighting in accordance with the transfer of the recording paper. In this case, however, there is the possibility of producing uneven illumination intensity in the band-like region, so that a reflecting surface of the housing 36 is corrugated or an irregularly reflected surface is formed. In the case of using a halogen lamp or an infrared lamp as the emissive heat source 35, since heat generation in the housing 36 is substantial, it is preferable to provide a ventilation means or a forced cooling means for light leakage.

Figure 3:
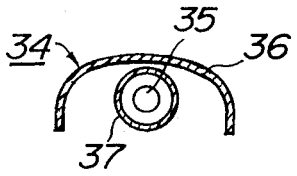
FIG. 3 is a sectional-view showing a construction of another embodiment of an emitting type fixing device shown in FIG. 1.

FIG. 3 is a cross-sectional view showing another construction of the emissive fixing device used in the electrophotographic apparatus according to the invention. The emissive fixing device 34 shown in FIG. 3 is made by enveloping the emissive heat source 35 with the cylindrical optical filter 37. As a result, any light leakage of undesirable wavelength can completely be prevented as well as the emissive fixing device 34 shown in FIG. 1.

As described above, according to the present invention, in the case of obtaining a duplicated copy based on the image-like information formed on the photosensitive charge retentive member, a non-fixed toner image formed on the recording paper is fixed by the emissive fixing device which removes light in the photosensitive wavelength region of the charge retentive member therefrom, so that no photosensitive effect is given to the charge retentive member by light leakage from the emissive fixing device. Accordingly, in the electrophotographic apparatus shown in FIG. 1, when a plurality of duplicated copies are obtained on the basis of an electrostatic latent image formed on the photoconductive drum 1 by repeating the development and transfer steps, there is no deterioration nor elimination of the electrostatic latent image caused by leaking light from the emissive fixing device 34, and even when a large number of the same duplicated copies are continuously obtained by repeating a step of obtaining one duplicated copy from the once formed electrostatic latent image, the photoconductive drum 1 is not locally fatigued by leaking light from the emissive fixing device 34, so that there is produced no local concentration unevenness.

The present invention is not limited to the above embodiments but may be variously modified or changed. For instance, an electrophotographic apparatus for obtaining a plurality of duplicated copies by exposing a document only once is constructed in such a manner that a conductive master image is formed on the photosensitive charge retentive member so as to repeat uniform charging, toner development and transfer, a permanent or temporary toner master image is formed on the photosensitive charge retentive member so as to repeat charging, uniform exposure, toner development and transfer, the formation of a secondary electrostatic latent image on the dielectric recording paper by modulation of a corona ion flow and the development thereof for visualizing it to a toner image are repeated on the basis of the electrostatic latent image formed on a screen-like photosensitive charge retentive member, or the latent image transfer for transferring an electrostatic latent image formed on the photosensitive charge retentive member into the charge retentive member for transfer and the toner development-transfer to the charge retentive member for transfer are repeated.

What is claimed is:

1. An electrophotographic apparatus for obtaining a plurality of duplicated copies from image-like information formed on a charge retentive member by one exposure, the apparatus comprising: a light source for illuminating a document to be copied, a photosensitive charge retentive member for forming image-like information thereon based on an optical image of the document through an optical system, a development means for forming a toner image on the charge retentive member to be transferred to recording paper based on the image-like information, a radiative fixing means for heating and fixing the toner image formed on the recording paper and including a radiation member for generating light having a wavelength at least mainly in a region other than the wavelength region of light to which the charge retentive member is sensitive and heats toner particles, and a cleaning means for eliminating residual toner particles after necessary member of transfer times are completed.

2. An electrophotographic apparatus as claimed in claim 1, wherein the development means directly develops the image-like information formed on the charge retentive member.

3. An electrophotographic apparatus as claimed in claim 1, further comprising a transfer member for forming secondary image-like information thereon by transferring the image-like information formed on the charge retentive member.

4. An electrophotographic apparatus as claimed in claim 3, wherein: the image-like information formed on the charge retentive member is a toner image.

5. An electrophotographic apparatus as claimed in claim 3, wherein the image-like information formed on the charge retentive member is an electrostatic latent image.

6. An electrophotographic apparatus as claimed in claim 3, wherein the image-like information formed on the charge retentive member is a conductive image.

7. An electrophotographic apparatus as claimed in claim 1, wherein: the radiative fixing means comprises a radiation source and a filter means for eliminating radiation in a wavelength region of light to which the charge retentive member is sensitive.

8. An electrophotographic apparatus as claimed in claim 7, wherein the radiation source is a xenon electronic-flash lamp or a halogen lamp.

9. An electrophotographic apparatus as claimed in claim 8, comprising a housing enclosing the xenon electronic-flash lamp or the halogen lamp, the inner surface of the housing being coated to form a reflecting mirror said housing having an opening for passage of heat from said lamp to the toner image on the recording paper, said filter means being mounted at the opening of the housing.

10. An electrophotographic apparatus as claimed in claim 7, wherein the filter means is of cylindrical shape and the xenon electronic-flash lamp or the halogen lamp is mounted in the cylindrical filter.

* * * * *